United States Patent [19]

Melford et al.

[11] Patent Number: 4,484,615

[45] Date of Patent: * Nov. 27, 1984

[54] ELECTRO-MAGNETIC STIRRING

[75] Inventors: David A. Melford, Saffron Walden; Keith R. Whittington, Great Shelford, both of England

[73] Assignee: TI (Group Services) Limited, Birmingham, England

[ * ] Notice: The portion of the term of this patent subsequent to Oct. 30, 2001 has been disclaimed.

[21] Appl. No.: 530,615

[22] Filed: Sep. 9, 1983

Related U.S. Application Data

[63] Continuation of Ser. No. 269,495, Jun. 1, 1981, abandoned.

[30] Foreign Application Priority Data

Jun. 5, 1980 [GB] United Kingdom ..... 8018372

[51] Int. Cl.[3] ..... B22D 27/02

[52] U.S. Cl. ..... 164/504; 164/468

[58] Field of Search ..... 164/468, 504, 499, 147.1; 266/233, 234

[56] References Cited

U.S. PATENT DOCUMENTS

| | | | |
|---|---|---|---|
| 1,256,705 | 2/1918 | Lebovici | 310/166 X |
| 2,861,302 | 11/1958 | Mann et al. | 164/504 |
| 4,137,961 | 2/1979 | Mola | 164/504 X |
| 4,200,141 | 4/1980 | Delassus | 164/504 |

FOREIGN PATENT DOCUMENTS

| | | | |
|---|---|---|---|
| 55-40004 | 3/1980 | Japan | 164/468 |
| 55-54245 | 4/1980 | Japan | 164/504 |

*Primary Examiner*—Kuang Y. Lin

*Attorney, Agent, or Firm*—Kemon & Estabrook

[57] ABSTRACT

An apparatus for stirring a molten metal in an open topped mould, in for example a continuous casting process, includes means positioned above the mould for producing a magnetic field which rotates about the vertical axis of the mould and penetrates down into the mould. The magnetic field may be produced by a series of electrical conductors which are positioned about the vertical axis of the mould, each of these conductors being connected to a different phase of a multi-phase alternating current supply.

12 Claims, 8 Drawing Figures

FIG. 4.
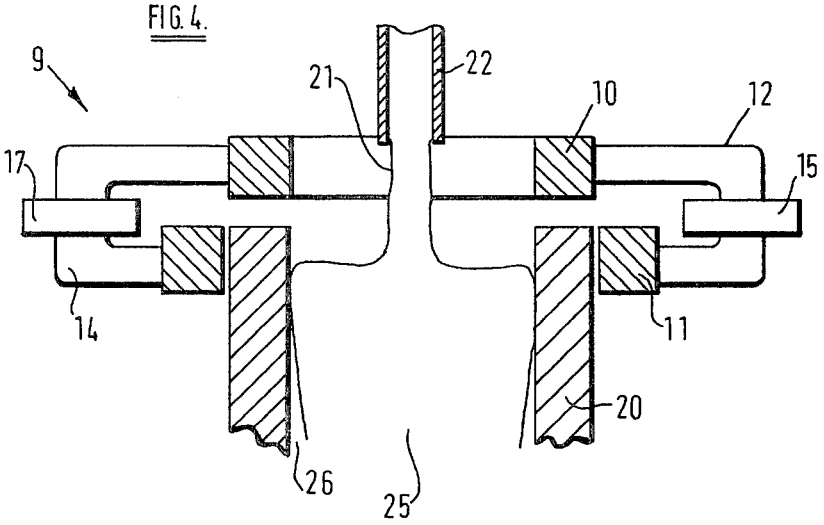
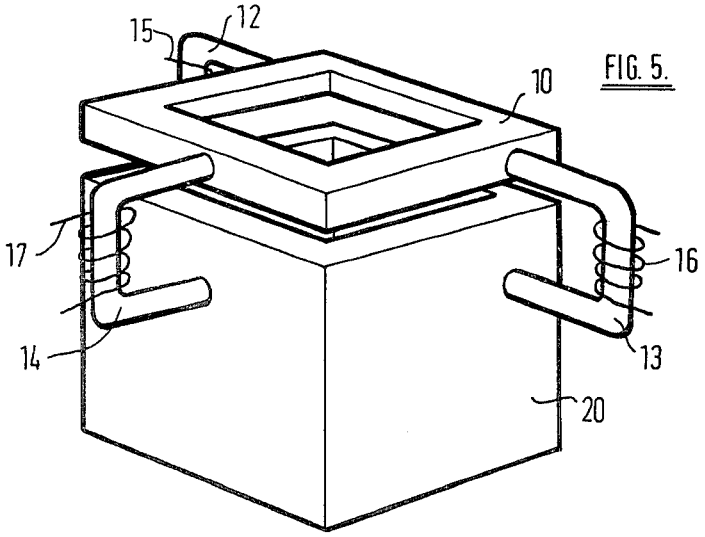
FIG. 5.

ELECTRO-MAGNETIC STIRRING

This application is a continuation of application Ser. No. 269,495, filed June 1, 1981 abandoned.

This invention relates to the stirring of molten metals.

When casting metals, for example steel by a continuous casting process, molten steel is poured into a water-cooled copper mould which defines the cross-sectional shape of the section to be cast which then emerges from the bottom of the mould as a continuous strand. As the molten steel contacts the mould, it solidifies to form a skin which gradually thickens as the strand passes through the mould, until at the lower end of the mould, a wall has been built up of sufficient thickness to contain the core of the strand which is still molten. After the strand leaves the mould it is normally further cooled by jets of water, so that the core gradually cools and solidifies from its outer surface, until the whole of the strand has solidified.

If the steel is allowed to solidify under normal conditions, an inhomogeneous structure is formed in which impurities are distributed non-randomly throughout the strand and also the crystal structure of the strand varies between the outer regions, which during the solidification process are subject to high temperature gradients, and the inner regions which are subjected to relatively low temperature gradients.

In order to obtain a homogeneous structure, it is desirable to agitate the molten metal throughout the casting process. It is known to stir the molten metal in the core of the strand, by means of electromagnetic transducers placed around the strand as it emerges from the mould. However in general, these methods do not adequately stir the metal in the region of the mould and sections produced in this manner have a discontinuity, sometimes termed "white-band". It is desirable therefore that some form of stirring is provided in the mould region itself. Attempts have been made to provide such stirring, by placing electromagnetic transducers around the mould. To date however it has proved difficult to achieve adequate stirring within the mould. The main reason for this is the high electrical conductivity of the copper mould, which substantially attenuates the magnetic field, but also difficulties arise in the postioning of the transducer around the mould, as for greatest effect they must be placed within the water cooling jacket of the mould.

According to one aspect of the present invention, an apparatus for stirring a molten metal in an open topped mould, includes means positioned above the mould, said means producing a magnetic field which rotates about the vertical axis of the mould and penetrates down into the mould.

The means of producing the rotating magnetic field, is preferably a stationary electromagnetic transducer. This electromagnetic transducer may conveniently be formed from a series of electrical conductors which are capable of carrying a high current, these conductors are spaced above the mould around its vertical axis and each of said conductors is connected to a different phase of a multiphase alternating current supply, the sequence of the conductors being the same as the sequence of the phases, so that the magnetic fields produced by the current passing through the conductors, will result in the desired rotating magnetic field.

Preferably the electrical conductors are made from nonferromagnetic electrically conductive materials, for example copper, in the form of closed loops. High currents are induced in these loops by means of energising coils which may either be wound about the conductor, or may be coupled thereto by ferromagnetic cores.

As the magnetic field produced by the transducer penetrates into the molten metal through the open top of the mould and not through the walls of the mould, there is comparatively little attenuation of the magnetic field and normal mains frequencies of 50 to 60 Hz may consequently be used, rather than the lower frequencies which have been found necessary with stirrers positioned around the mould. Typically, the electromagnetic transducer will be designed, so that when the energising coils are connected to one phase of a three-phase alternating current mains supply, a current in excess of 10,000 amps at a voltage drop of the order of 1 or 2 volts and frequency of 50 to 60 Hz will be induced in the conductors.

Various aspects of the present invention are now described, by way of example only, with reference to the accompanying drawings, in which:

FIGS. 4, 5 and 6 illustrate alternative forms of electromagnetic transducer, that may be used in accordance with the present invention.

Figure 1:
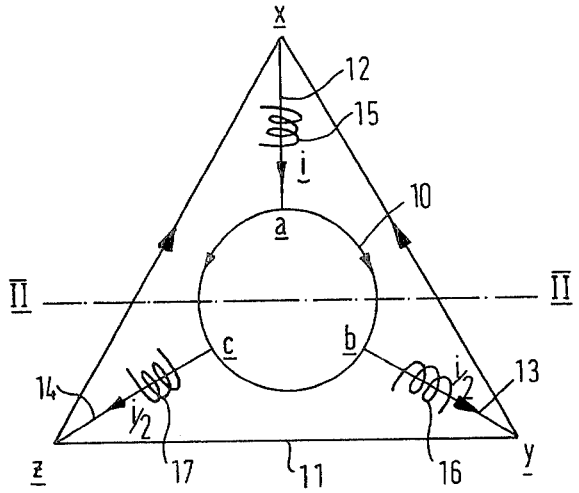
FIG. 1 is a diagrammatic illustration of one form of electromagnetic transducer that may be used in accordance with the present invention.
Figure 2:
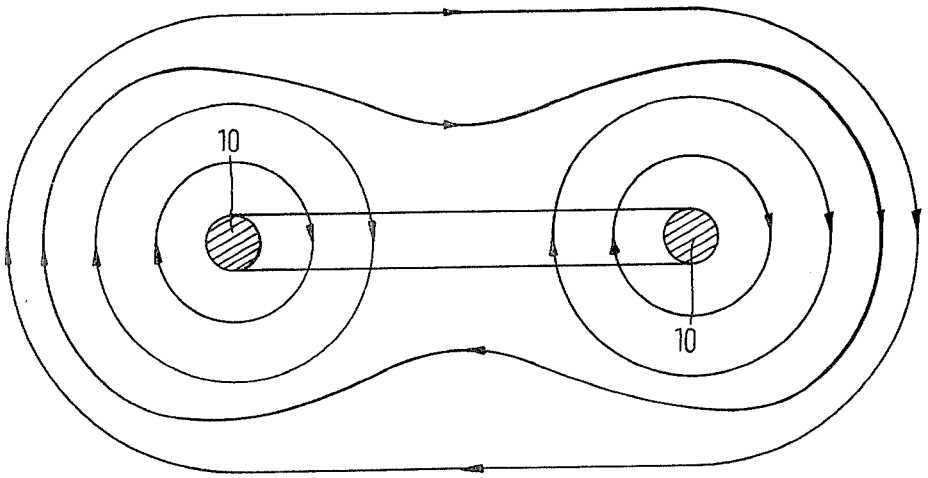
FIG. 2 shows the magnetic field produced by the central ring on the line II—II in FIG. 1, at a given point in the alternating current supply cycle.

The electromagnetic transducer illustrated in FIG. 1 comprises an inner ring 10 and outer ring 11 formed from stout copper bars, these rings being inter-connected a 3 positions a, b, c and x, y, z respectively by copper bars 12, 13 and 14. Toroidal energizing coils 15, 16 and 17 are provided on the copper bars 12, 13 and 14 and each of these energising coils 15, 16 and 17 is connected to a different phase of a three-phase alternating current mains supply. The passage of the mains current supply through the energising coils 15, 16 and 17 induces currents in the copper bars 12, 13 and 14 respectively the strength and direction of these currents depending on the position in the cycle of the three-phase mains supply. Depending on the strength and direction of the currents induced in the bars 12, 13 and 14, resultant currents will also flow in at least 2 of the sectors ab, bc and ca of the inner ring 10 and sectors xy, yz, zx of the outer ring 11. For example consider the situation when the current flowing through the coil 15 connected to the first phase of the mains supply is at a maximum and the currents flowing through the coils 16 and 17 which are connected to the second and third phases of the mains supply respectively are at half the maximum. Under these conditions the current induced in the bar 12 will be i and will flow towards the inner ring 10 whilst the currents induced in the bars 13 and 14 will be i/2 and flow away from the ring 10. As a result of the currents induced in the bars 12, 13 and 14, currents will flow in the closed loops abyx and aczx as illustrated in FIG. 1, no currents will flow in the bars bc or yz. The currents in the sectors ab and ac of the inner ring 10 will be equal and will produce magnetic fields around those segments, as illustrated in FIG. 2. As the currents in sectors ab and ac are in the same direction, the magnetic fields produced within the inner ring 10 will substantially cancel each other out; however the magnetic fields above and below the ring 10 will reinforce one another and the resultant magnetic field M will lie substantially parallel to the plane of the ring 10 above and below the ring 10, as indicated by the arrows in FIG. 3. As the phase of the mains supply changes, the distribution of currents in the conductors will change and the magnetic field M induced by these currents will rotate about the axis perpendicular to the plane of the inner ring 10. Magnetic fields are also produced by the currents flowing in the outer ring 11, however in practice these will be well spaced from the stirring area and will have little effect.

Figure 3:
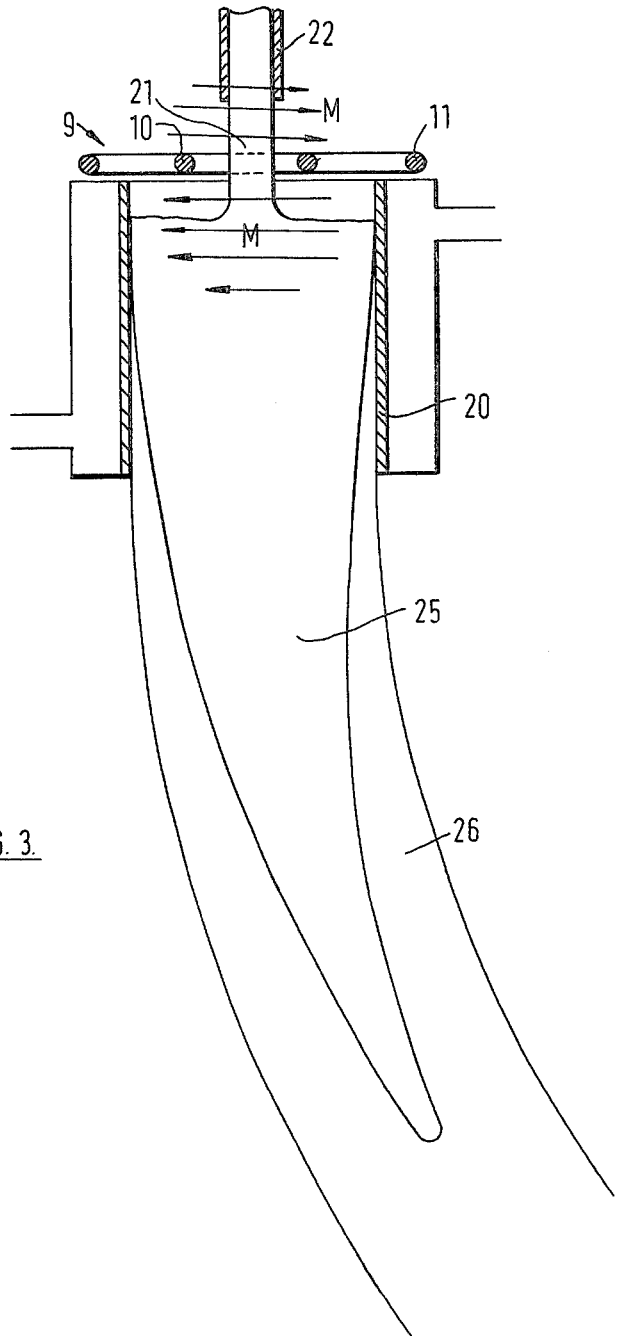
FIG. 3 is a diagrammatic illustration of a continuous casting apparatus including an electromagnetic transducer formed in accordance with the present invention.

In use in a continuous casting apparatus the transducer 9 (FIG. 3) described with reference to FIGS. 1 and 2 is positioned adjacent the top of a water cooled copper mould 20 and is co-axial with the mould 20, so that stirring will take place about the longitudinal axis of the mould 20. The inner ring 10 provides sufficient clearance to facilitate pouring of the liquid metal 21 into the mould from a tundish via a ceramic nozzle 22 as illustrated in FIG. 3. The rotating magnetic field M created by the transducer 9, induces an electric current in the molten metal 21 within the mould 20, which in turn creates a magnetic field which interacts with the magnetic field M produced by the transducer 9. This interaction of the magnetic fields causes the molten metal 21 in the mould 20 to rotate with the magnetic field M, around the longitudinal axis of the mould 20. This stirring motion causes the lighter impurities in the molten steel 21 to be centrifuged towards the centre of the mould 20 and also encourages the formation of a uniform crystaline structure within the mould 20.

As a magnetic field M enters the mould 20 through the open end thereof, the high electrical conductivity of the copper walls of the mould 20 has no attenuating effect on the magnetic field M.

The efficiency of the transducer described with reference to FIGS. 1 to 3, may be enhanced by positioning ring 11 below ring 10 as illustrated in FIG. 4. In this configuration, the magnetic field M produced below the upper ring 10 and that produced above the lower ring 11 will reinforce one another to produce a relatively strong magnetic field between the rings 10 and 11. With this configuration of transducer, the upper ring 10 may be made to the same dimensions as the mould opening, so that the opening of the mould 20 is not obstructed. The lower ring 11 is made slightly greater than the outside dimension of the mould 20, so that the transducer may be positioned with the ring 11 around the upper edge of the mould 20 and the ring 10 positioned above mould 20, but in close proximity thereto. In this manner there will be a maximum penetration of the magnetic field produced by the rings 10 and 11, into the mould 20.

The transducers illustrated in FIGS. 3 and 4, are installed above the mould, in close proximity to the top thereof and there is no need to redesign the mould or modify the mould in any way. These transducers are consequently particularly suitable for the conversion of existing casting apparatus. Where new casting moulds are being constructed, the mould 20 may itself be used as the lower ring 11, as illustrated in FIG. 5.

Figure 6:
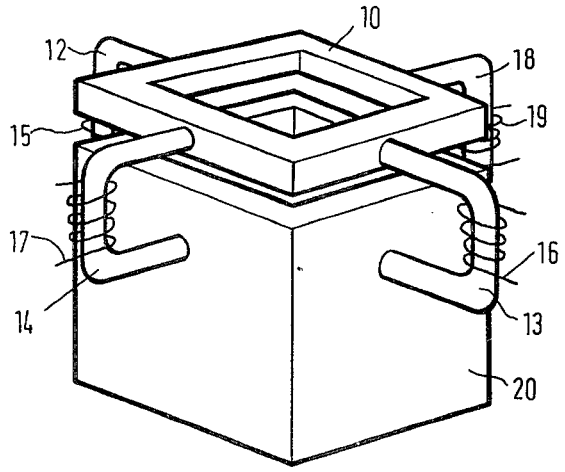
Figure 7:
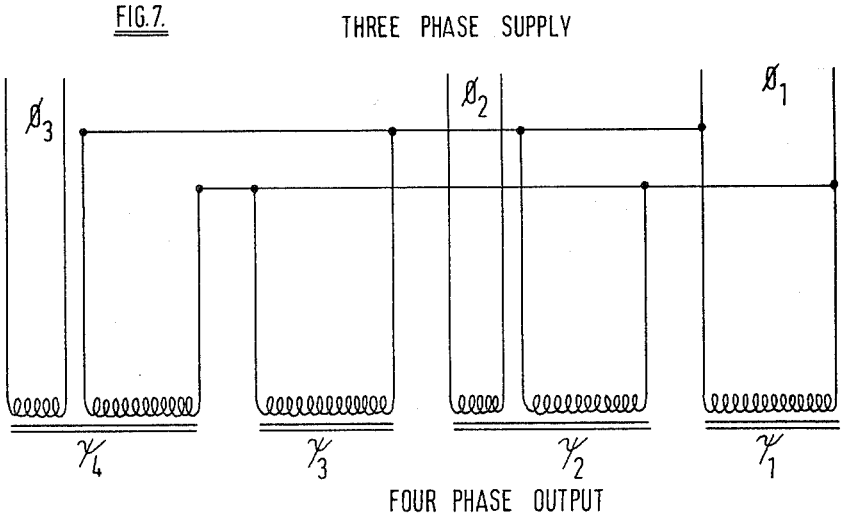
FIG. 7 shows a circuit for converting a three phase mains alternating current supply into a four phase alternating current for use in conjunction with the transducer illustrated in FIG. 6.

The transducers described above, are conveniently formed with a series of three conductors, which are energised sequentially by means of a three-phase alternating current mains supply. This is particularly suitable for moulds of circular cross section, but may also be used for square or rectangular moulds as illustrated in FIG. 5. However because it has four sides, it is possible in practice to adopt a symetrical disposition, in which each wall of the mould 20 is connected to the upper ring 10 by a copper bar (12, 13, 14, 18), an energising coil (15, 16, 17, 19) being coupled to each of the bars (12, 13, 14, 18), as illustrated in FIG. 6. In this case a four rather than three-phase alternating current is required and the normal three-phase alternating current mains supply may be converted into four-phase supply using circuitry such as illustrated in FIG. 7.

It is of course convenient to use the three-phase alternating current mains supply. However any multiphase alternating current supply may be used, to suit the cross section of the mould and other design requirements.

Figure 8:
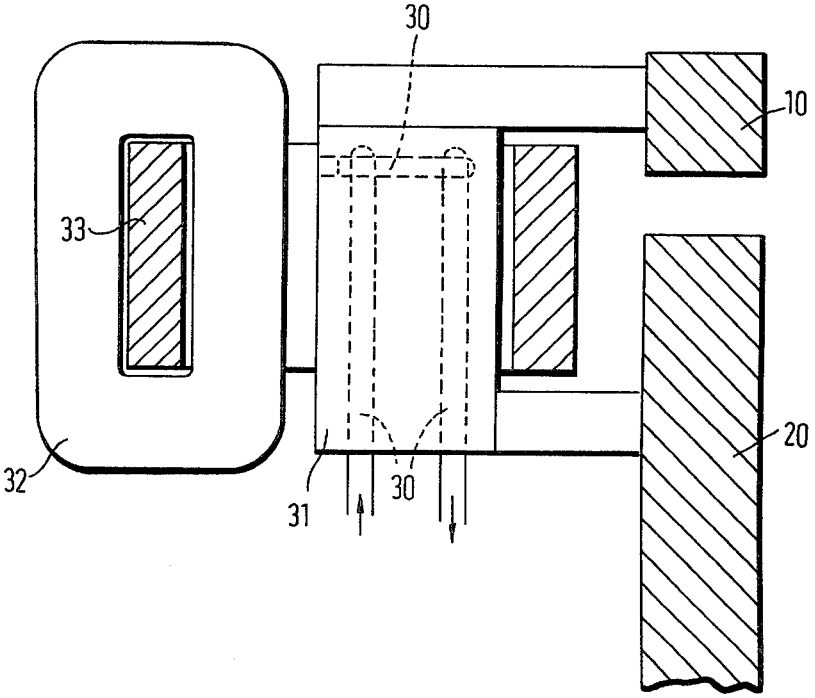
FIG. 8 shows an alternative method of coupling the energising coils to the conductors, which may be used in any of the embodiments illustrated in FIGS. 3 to 6.

In the embodiment described with reference to FIGS. 3 to 6, the energising coils are wound about the copper conductors. However, these conductors are heated by the radiant heat from the molten metal and also by the high current flowing through the conductors, and there is consequently a danger that the energising coils will be damaged by excessive heat. As illustrated in FIG. 8, this problem may be overcome by providing ducts 30 in at least the portions 31 in at least the portions 31 of the conductors adjacent to energising coils 32, through which ducts 30 a coolant, for example water, may be passed, or the coils 32 themselves may be cooled by a suitable means. Furthermore the danger of the coils 32 overheating may also be reduced, by coupling the helical coils 32 to the conductors 31 by means of ferromagnetic cores 33 as illustrated in FIG. 8. These ferromagnetic cores 33 may advantageously be of laminated construction the relatively delicate parts of the stirrer, that is the energizing coils, are positioned away from the flux path of the magnetic field into the mold. The energizing coils may consequently be shielded and/or surrounded by water jackets, without effecting the magnetic field.

While the present invention has been described in relation to the continuous casting of metals and in particular steel, it may be used generally to stir molten metal in any form of mould. Furthermore while the transducers described above are particularly useful for stirring molten metals in open containers with walls formed from materials of high electrical conductivity which would significantly attenuate the magnetic fields, they may also be used to stir molten metals in open or closed containers made of materials of low or non-electrical conductivity.

Various modifications may be made to the embodiment described above without departing from the invention. For example, in any of the embodiments where the energising coils are described as being wound about the copper conductors, it is necessary to provide adequate insulation and also the coils are preferably wound onto an appropriately shaped ferromagnetic core.

Where four conductors 12, 13, 14, 18 are used, as in FIG. 6, an alternative to the four-phase supply shown in FIG. 7 may be utilised comprising connecting the coils 15 and 16 to the same phase of a three-phase supply, with coil 15 connected in the reverse sense to coil 16.

Similarly, coils 17 and 19 are connected in reverse sense to the same one of the other phases of the three-phase supply.

The arrangement shown in FIGS. 5 and 6, which uses the mould itself as the lower ring, can also be used on existing moulds, where it is convenient to do so.

In FIGS. 5 or 6 the copper bars 12, 13, 14, 18 may be connected from the corners of the mould 20 either to the corresponding corners of the ring 10 or to the sides of ring 10.

In some embodiments it may be advantageous to provide more than one energising coil 15, 16, 17, 18 per phase. In such an arrangement for a three-phase supply, 6 or 9 coils, each on a corresponding copper bar are arranged around the mould 20 and ring 10 with the first, fourth, etc. coils connected to the first phase, the second, fifth etc. coils connected to the second phase and the third, sixth, etc. coils connected to the third phase. Such and arrangement may be of benefit for stirring an elongate rectangular mould, for example of the kind used for continuous casting of slabs, where more than one ceramic nozzle 22 are positioned along the longitudinal centre line of the mould in a relatively low stirred velocity zone, to reduce erosion of the nozzles 22.

We claim:

1. An apparatus for stirring a molten metal in an open topped mold comprising; a series of three or more closed loops made from bars of non-ferromagnetic electrically conductive material, these loops being positioned around the vertical axis of the mold so that a portion of each loop forms one of a ring of conductive elements surrounding the vertical axis of the mold and positioned above the mold; each of said loops being coupled inductively via an energizing coil, to a different phase of a multiphase alternating current supply, the sequence of the loops being the same as the sequence of the phases, so that currents induced in the loops will produce a magnetic field above the mold, said magnetic field penetrating down into the mold and rotating about the vertical axis of the mold; said energizing coils being located outside the flux path of the magnetic field into the mold.

2. An apparatus as in claim 1 in which the series of closed loops are provided by a pair of coaxial rings inter-connected by three or more links, to form a series of closed loops, each link being coupled to an energizing coil.

3. An apparatus as in claim 2 in which the rings are positioned one above the other.

4. An apparatus as in claim 2 in which the upper ring is positioned slightly above the top of the mould and the lower ring surrounds the upper edge of the mould.

5. An apparatus as in claim 2 in which the lower ring is formed by the walls of the mould.

6. An apparatus as in claim 1 in which the cloud loops are made of copper.

7. An apparatus as in claim 1 in which the closed loops are provided with ducts through which a coolant may be circulated.

8. An apparatus as in claim 1 in which each energising coil is wound about its associated closed loop.

9. An apparatus as in claim 1 in which the energising coils are coupled to the closed loops by means of ferromagnetic cores.

10. An apparatus as in claim 1 in which the multiphase alternating current supply has a frequency of from 50 to 60 Hz.

11. An apparatus as in claim 1 in which the current in the conductors is at least 10,000 amps at a voltage drop of about 1 or 2 volts.

12. A continuous casting apparatus including a mould and a stirrer as claimed in claim 1 positioned at least partially above the mould, said stirrer being arranged to produce a magnetic field within the mould, said magnetic field rotating about the longitudinal axis of the mould.

* * * * *